US006183133B1

(12) United States Patent
Roegner

(10) Patent No.: US 6,183,133 B1
(45) **Date of Patent: *Feb. 6, 2001**

(54) EXPANABLE MULTIPOCKET CARRYING CASE

(76) Inventor: DeAnna Roegner, 774 Mays Blvd., #10-405, Incline Village, NV (US) 89451

( * ) Notice: Under 35 U.S.C. 154(b), the term of this patent shall be extended for 0 days.

This patent is subject to a terminal disclaimer.

(21) Appl. No.: 09/274,122

(22) Filed: Mar. 23, 1999

Related U.S. Application Data

(63) Continuation-in-part of application No. 09/042,143, filed on Mar. 13, 1998, now Pat. No. 5,897,209, which is a continuation of application No. 08/671,396, filed on Jun. 26, 1996, now abandoned.

(51) Int. Cl.[7] ..... B65D 30/22

(52) U.S. Cl. ..... 383/39; 150/113; 190/103; 190/110; 190/111

(58) Field of Search ..... 190/103, 104, 190/109, 110, 111; 150/112, 113, 114; 383/97, 38, 39

(56) References Cited

U.S. PATENT DOCUMENTS

| | | | | |
|---|---|---|---|---|
| D. 276,954 | | 1/1985 | Kruger | D3/43 |
| D. 285,748 | * | 9/1986 | Feinberg et al. | 190/103 X |
| D. 345,651 | | 4/1994 | Copp | D3/285 |
| D. 355,301 | | 2/1995 | Tumulty | D3/289 |
| D. 358,483 | | 5/1995 | Cross et al. | D3/276 |
| D. 379,267 | * | 5/1997 | Roegner | D3/285 |
| D. 407,559 | * | 4/1999 | Roegner | D3/319 |
| 1,513,514 | | 10/1924 | London | 383/39 |
| 1,684,232 | | 9/1928 | Levit | 383/39 |
| 1,705,149 | | 3/1929 | Brady | 383/39 |
| 2,011,879 | | 8/1935 | Stein | 190/901 X |
| 2,359,372 | | 10/1944 | Leader | 383/39 |
| 2,532,517 | | 12/1950 | Schwartzman et al. | 383/39 |
| 2,554,215 | | 5/1951 | Schell et al. | 190/901 X |
| 2,674,288 | | 4/1954 | Laidlow | 383/39 X |
| 2,873,781 | | 2/1959 | Langley | 383/39 |
| 3,443,671 | * | 5/1969 | Dyke | 383/97 X |
| 3,533,459 | | 10/1970 | Ody | 150/113 |
| 3,963,102 | * | 6/1976 | Carp | 190/109 X |
| 4,090,593 | * | 5/1978 | Koff | 190/103 |
| 4,506,769 | | 3/1985 | Franco et al. | 190/127 X |
| 4,513,866 | | 4/1985 | Thomas | 190/110 X |

(List continued on next page.)

FOREIGN PATENT DOCUMENTS

| | | |
|---|---|---|
| 97 15 908 U | 12/1987 | (DE) . |
| 1287867 | 2/1962 | (FR) . |

*Primary Examiner*—Jes F. Pascua
(74) *Attorney, Agent, or Firm*—Baker & Maxham

(57) ABSTRACT

A multipocket carrying case, comprises a primary shell of pliable material formed of a pair of substantially identical half shells connected together for hinging along a common side and forming a primary receptacle, each half shell formed of a rectangular back panel with a bottom panel, a top panel and two end panels secured along the periphery of the back panel forming a primary receptacle, a multipocket panel assembly secured to the back panel and comprising a zig zag or pleated folded panel forming overlapping front and back folds, the back folds secured to a back panel forming a plurality of pockets having spaces therebetween, and a closure panel secured along an edge to the back panel to thereby overlap and close the plurality of pockets.

Another embodiment of the carrying case comprises an expandable and adjustable case for carrying many differing types of items in an organized fashion, and particularly suited for carrying a few clothing items. This embodiment of the invention includes, in kit form, multiple accessory storage devices in various multiple pocket assembly designs and a portable case with adjustable partitionable members.

15 Claims, 16 Drawing Sheets

U.S. PATENT DOCUMENTS

| | | | | |
|---|---|---|---|---|
| 4,569,082 | | 2/1986 | Ainsworth et al. | 383/3 |
| 4,585,127 | | 4/1986 | Benedict | 383/39 X |
| 4,739,809 | | 4/1988 | Adams | 150/112 |
| 4,854,432 | | 8/1989 | Carpenter et al. | 190/110 |
| 4,960,204 | | 10/1990 | Young et al. | 383/39 X |
| 5,010,988 | * | 4/1991 | Brown | 190/104 |
| 5,052,555 | | 10/1991 | Harmon | 206/315.11 |
| 5,096,030 | | 3/1992 | Espinosa et al. | 190/110 X |
| 5,160,001 | | 11/1992 | Marceau | 190/102 |
| 5,423,404 | | 6/1995 | Shaw | 190/102 |
| 5,598,923 | | 2/1997 | Owens | 383/39 X |
| 5,779,033 | | 7/1998 | Roegner | 206/6.1 |
| 5,865,233 | * | 2/1999 | Roegner | 190/110 X |
| 5,890,587 | * | 4/1999 | Roegner | 206/6.1 |
| 5,897,209 | * | 4/1999 | Roegner | 190/110 X |
| 6,000,509 | * | 12/1999 | Chisholm | 190/109 |

* cited by examiner

EXPANABLE MULTIPOCKET CARRYING CASE

REFERENCE TO RELATED APPLICATION

The present application is a continuation-in-part of application Ser. No. 09/042,143, entitled "MULTIPOCKETED CASE," filed Mar. 13, 1998, now U.S. Pat. No. 5,897,209, which was a continuation of application Ser. No. 08/671,396, filed Jun. 26, 1996, now abandoned.

BACKGROUND OF THE INVENTION

The present invention relates to carrying cases and pertains particularly to an expandable carrying case having an improved arrangement of multiple pocket assemblies and insertable smaller cases in kit form.

People often carry many items that are often placed loosely in a suitcase when traveling. These items are usually disorganized and difficult to locate. Some of these people are also engaged in a profession or trade that entails carrying with them numerous business or trade related items such as toiletries, cosmetics, samples or tools. Often, these items are transported to a business or work site in a special carrying case specifically designed for these items.

In the above identified parent application, I disclose a multipocketed carrying case having a variety of pockets in removable inserts, which is convenient for an overnight bag. It is particularly convenient for carrying toiletries, cosmetics and personal items for travel.

Frequently, overnight travelers often need a change of a few items of clothing such as a shirt and/or underwear. In such instances, it is not always convenient or desirable to carry another bag. Accordingly it is desirable that there be available a carrying case that may be expandable for carrying a small number of items of clothing in addition to the usual toiletries, cosmetics and the like.

There is a need for a carrying case that is adaptable to carry many related or unrelated items in an organized fashion, and be expandable for carrying a small number of items of clothing. It would be desirable to have a case with multiple pockets for holding articles of different sizes in a secure manner and that also allows ease of accessibility.

SUMMARY OF THE INVENTION

It is the primary object of the present invention to provide an improved case with multiple pockets for holding articles of different sizes secure and readily accessible.

A multipocketed carrying case, comprises a primary shell of pliable material, the shell formed of a pair of substantially identical half shells connected together for hinging along a common side and forming a primary receptacle, each half shell formed of a rectangular back panel with a bottom panel, a top panel and two end panels secured along the periphery of the back panel forming the receptacle, a multipocket panel assembly secured to the back panel of the half shell and comprising a pleated or zig zag folded panel forming overlapping front and back panels, these back panels are secured to another back panel forming a plurality of pockets having spaces therebetween, and a closure panel secured along an edge to the back panel to thereby overlap and close the plurality of pockets.

In an alternate embodiment of the invention, a multipocket assembly is detachably secured to the back panels of the shell and includes means for hanging from a hanger or the like to enable a pocket assembly to be used with multiple differing cases or multiple pocket assemblies to be used with a single case.

Another embodiment of the carrying case comprises an adjustable and expandable case for carrying many types of items in an organized fashion, and particularly suited for carrying a few clothing items. This embodiment of the invention has multiple pocket assembly devices for holding articles of different sizes in a secure manner that are readily accessible to a user. This embodiment of the invention includes, in kit form, multiple accessory storage devices that include various multiple pocket assembly designs and a portable case with adjustable partitionable members.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
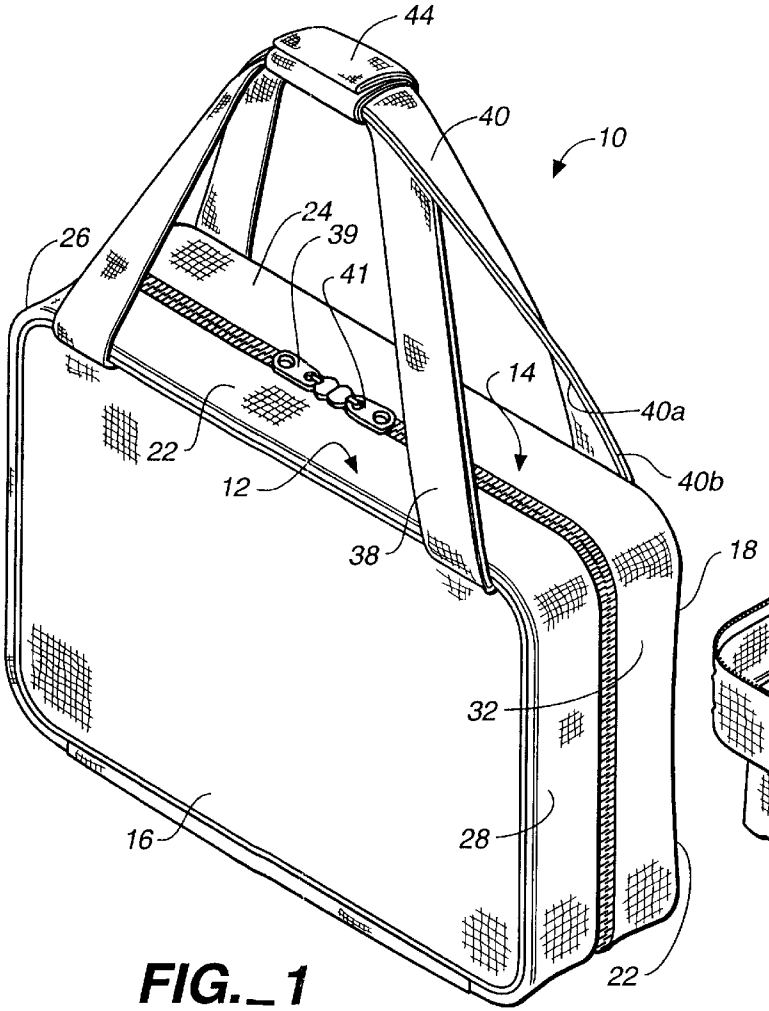
FIG. 1 is a perspective view of an exemplary preferred embodiment of the invention with the case closed.

Referring to FIG. 1 of the drawing, the carrying case in accordance with the invention is illustrated and designated generally by the numeral 10. The case is preferably constructed of a pliable material, such as leather, vinyl, or any of the suitable woven materials, now widely used for suit cases and the like. The case comprises a primary shell formed of a pair of substantially identical half shells 12 and 14, hinged together along a common side and forming a primary receptacle. Each shell is formed of a generally rectangular back panel 16 and 18 respectively, with a bottom panel 20 which is preferably common to both half shells with a continuous strip forming top panels 22 and 24, end panels 26, 28, 30 and 32, respectively, for forming each of the half shells into the primary receptacle. The half shells are secured together along edges of the side and top panels by zipper elements 34 and 36 with sliders 39 and 41 at each side or end of the zipper elements. The bottom panel 20 flexes so as to function as a hinge for the two half shells.

Each half shell is provided with an elongated carrying strap 38 and 40, respectively, which detachably secure together at a mid point and are preferably adjustable in length to serve as either a handle or a shoulder strap. The strap 40, for example, is preferably secured at one end directly to the side of the shell and at the other end through a slip loop and to the shell with the opposite end adjustably secured by a buckle (not shown) underneath a hand grip 44. The hand grip 44 is of conventional construction and preferably forms a slip sleeve over the buckle of one of the straps and opening sleeve secured together in a closed position around the other buckle by suitable means, such as hook and loop fastening means, such as that available under the trademark VELCRO. This enables the straps to be adjusted so that they may serve as a hand carrying strap or shoulder strap, as desired.

Figure 2:
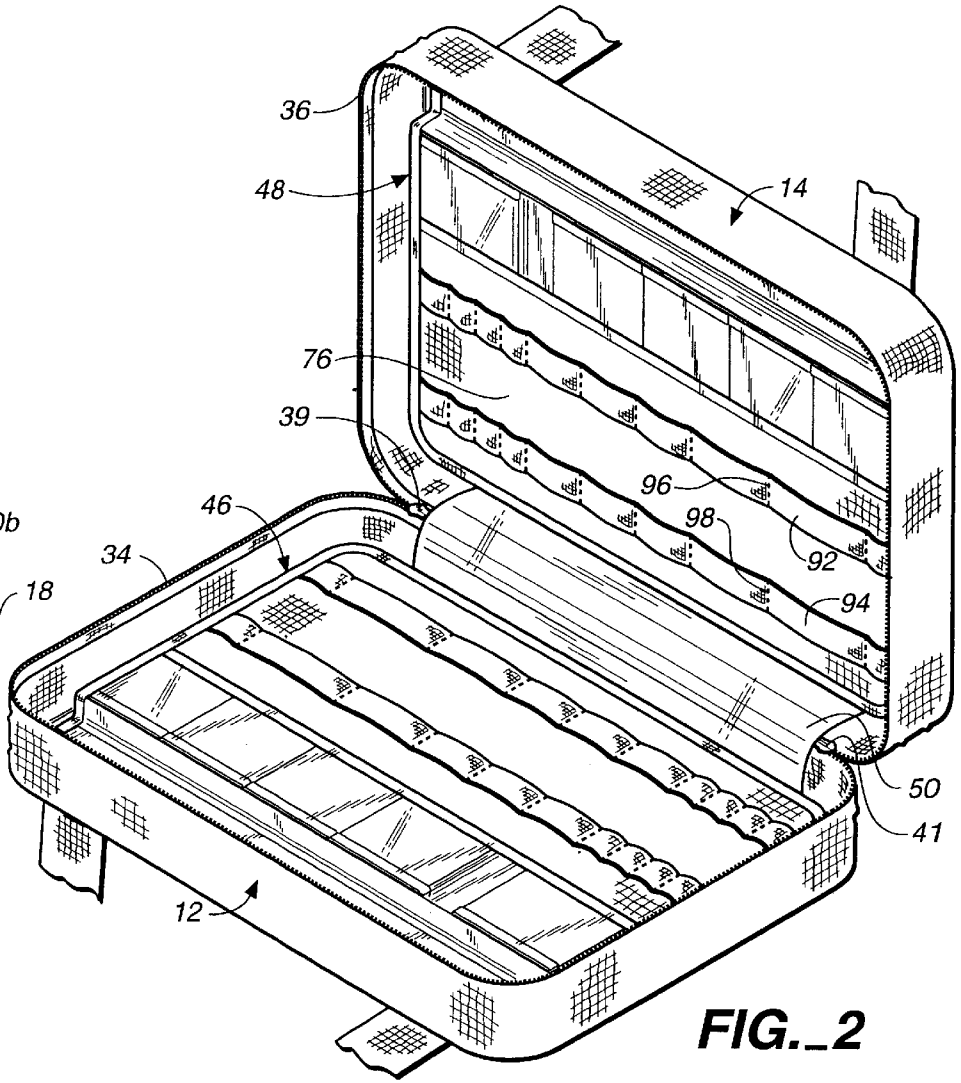
FIG. 2 is a perspective view of the embodiment of FIG. 1 with the case open.

As seen in FIG. 2, the overall carrying case is provided with substantially identical pocket assemblies designated generally by the numerals 46 and 48, respectively, separately positioned in each of the respective half shells. The pocket assemblies are in a preferred form formed on a common back panel 50 which extends into and may preferably form at least a partial liner in each receptacle of each half shell. The back panel 50 may preferably be a transparent material, such as vinyl or the like.

Figure 3:
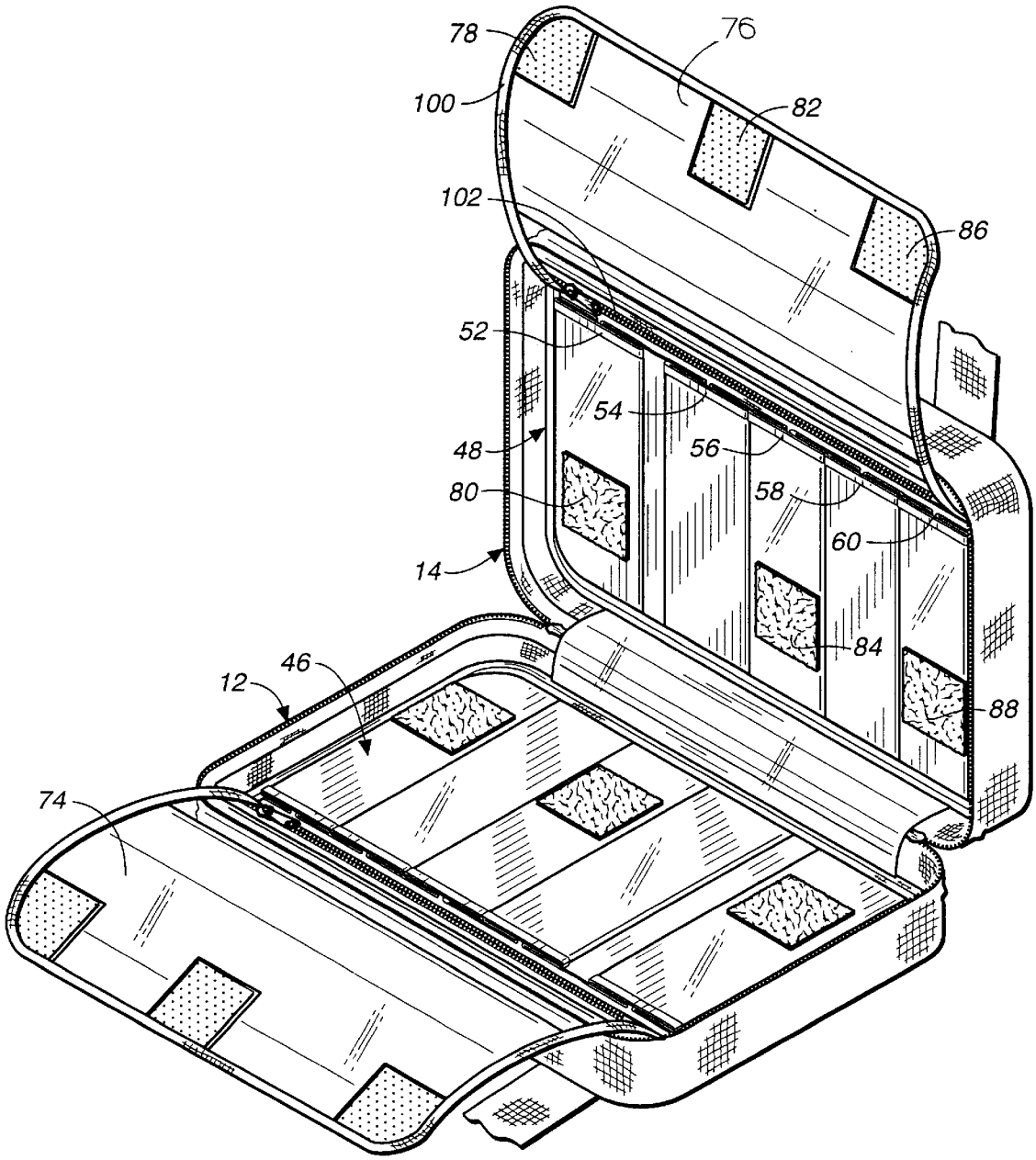
FIG. 3 is a perspective view of the invention as in FIG. 2 with an internal flap folded foward to be open in the bottom half; a similar internal flap present in the top half with the flap shown in its open position.

Referring to FIG. 3, the pockets of each of the multipocket assemblies in this embodiment is illustrated as extending from the bottom of the shell, as viewed in FIG. 1, to the top of the shell so that when standing in FIG. 1, the openings of the pockets are positioned at the top of the case. However, as will be appreciated, the pocket assemblies may be formed such that the pockets open in a common direction when viewed as in FIG. 4 or 5, so that the case can be hung in a manner that all pockets open to the top or upward.

The pocket assembly for each half shell is identical and therefore only a single pocket assembly will be described in detail. With reference to FIG. 3, the pocket assembly 48 will be described. As best seen in FIG. 3, the pocket assembly has five primary open top pockets, 52, 54, 56, 58, and 60, respectively, and alternative open sided pockets between them. The pockets are formed of an overlapping transparent panel with pleated or zig-zag accordion-like folds, as can be seen in FIGS. 3 and 11, that form collapsed pockets with folded sides between a forward or front and a rearward or back panel section of each pocket.

Figure 11:
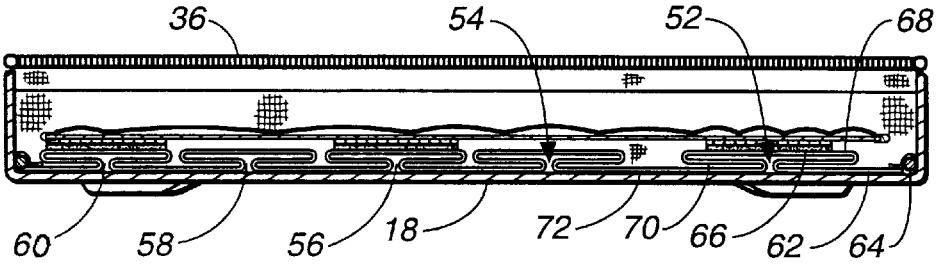
FIG. 11 shows a cross section of FIG. 5 taken at 11—11 showing pockets of the multipocketed design.

Referring to FIG. 11, the pockets are formed by a continuous panel that is folded in the pleated or zig zag collapsed position as shown, when the pockets are empty. The pockets are formed by the panel which is folded so that with respect to pocket 52, for example, an aft panel portion 62 lies against the back panel and is secured along an edge 64 to the back pocket panel 18 and/or the panel of the shell. A side panel portion or section 66 is folded down between the aft panel portion 62 and a fore or front pocket panel portion 68 which forms the front of the pocket. The excess material of side portions 66 (FIG. 11) permits expansion of the open top pockets and provides size, shape, and definition to the open sided pockets between the open top pockets.

The opposite side of the pocket is similarly formed with a folded side pocket panel portion or section 70 and an adjacent aft panel portion 72. The aft panel portion 72 is preferably secured along a proximate center line to the back panel 18. The remaining pockets, as can be seen in FIG. 11, are similarly constructed with collapsed or folded sides such that when the pocket is partially filled an adjacent space between adjacent pockets form an open sided pocket and is available for the placement of additional articles. However, the pockets are constructed so that they can be completely filled, such that no additional space or open sided pockets exist between adjacent pockets. Also, as can be appreciated from viewing FIGS. 3 and 11, the adjacent pockets 52 and 54 may be spaced further apart than other pockets within the unit to provide a larger space or open sided pocket between them. These pockets are also constructed to be slightly larger than the other pockets. As can be seen from FIGS. 3, 5, 13 and 15, the edge of the front, pleated panels opposite to the open tops of pockets 52, 54, 56, 58, 60 are secured to back panel 18 to effectively close the bottom ends of the open sided pockets which are formed between the open top pockets.

Referring back to FIG. 3, each of the pocket assemblies includes a flap or cover 74 and 76, each of which is preferably at least partially transparent, preferably at the top of the pockets. These covers or flaps are preferably secured to the pocket assembly along a top edge of the pocket assembly adjacent to the openings or tops of the respective pockets. The flap can thus fold down over the pockets to retain items in both the open top and the open sided pockets. Suitable members used for securing the flaps or covers closed, preferably include pairs of hook and loop type fastening means 78, 80, 82, 84, 86, and 88.

Referring to FIG. 2 again, wherein the flap or cover 76 is shown closed over the pockets of the pocket assembly 48. It will be seen that the upper portion of the cover 76 is transparent at the top of the pockets. The outer face of the panel, as shown in FIG. 2, includes a pair of elongated elastic straps 92 and 94 secured such as by stitching at multiple points, such as 96 and 98 along the face of the panel, as shown in FIG. 2, to form a plurality of loops for holding additional small articles.

As shown in FIG. 3, each panel is also preferably formed of two layers of material secured around the peripheral edge by a band 100 and with an opening formed with a zipper 102 to provide access to the pocket. The pocket is suitable for small, thin items, such as papers and the like.

Figure 4:
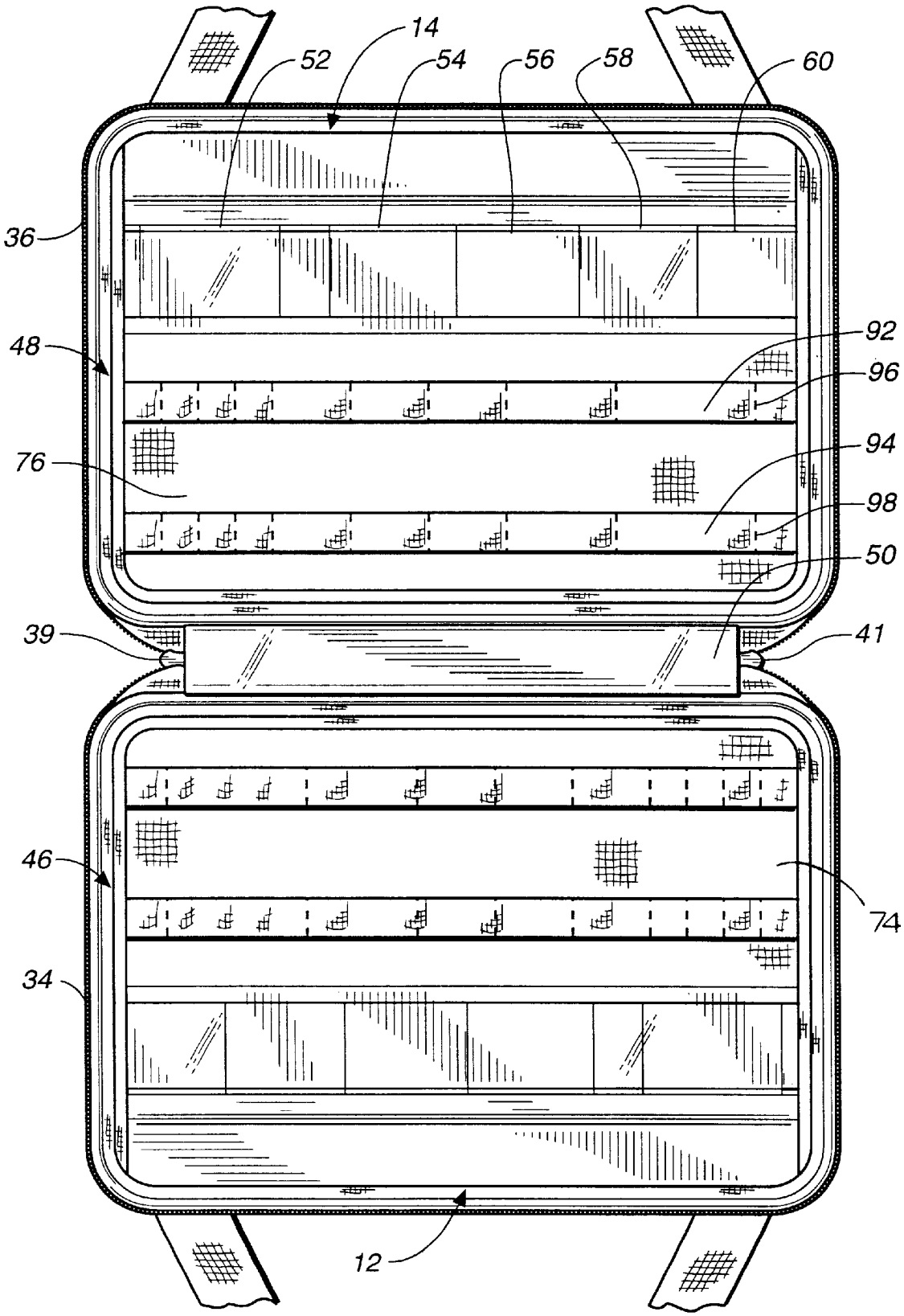
FIG. 4 is a top view of the invention showing the inside construction with the case folded flat in an open clam shell configuration; both internal flaps in their closed position.
Figure 5:
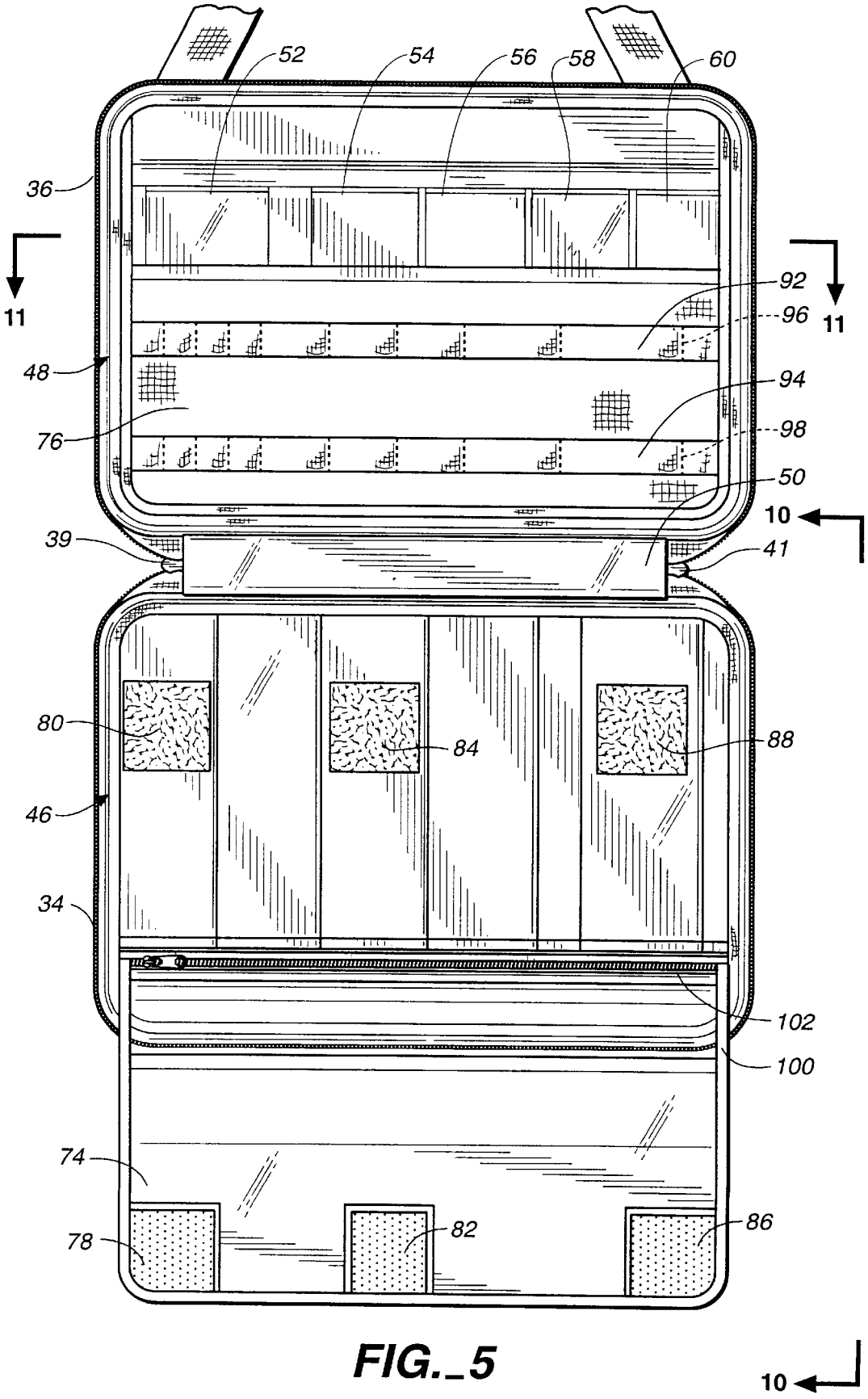
FIG. 5 is a top view of the invention showing the inside construction with the case folded flat in an open clam shell configuration as in FIG. 4 with the internal flap of the lower half folded open; with the internal flap of the upper half shown in its closed position.
Figure 6:
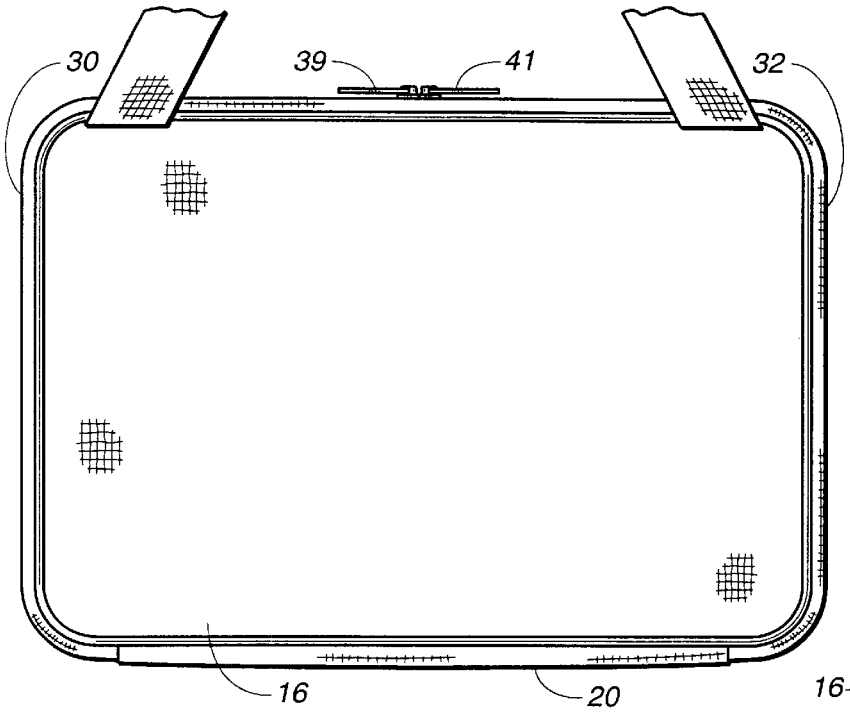
FIG. 6 is a front elevation view of the outside of the case with part of the hand straps being cut away, the back view being identical.

Referring to FIGS. 4 and 5, the case is shown fully open like a book with both pocket assemblies covered. The flaps 74 and 76 open over the pockets from opposite sides like the pages of a book to provide access to the pockets. The flaps are transparent at least in the portions over the top or openings of the pockets so that articles may be easily seen and identified.

Figure 7:
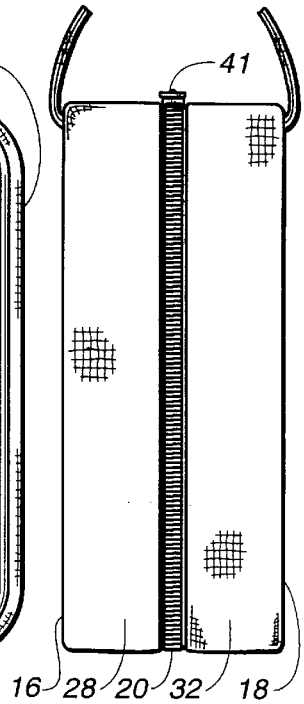
FIG. 7 is a right side view of FIG. 6, the left side being identical.
Figure 8:
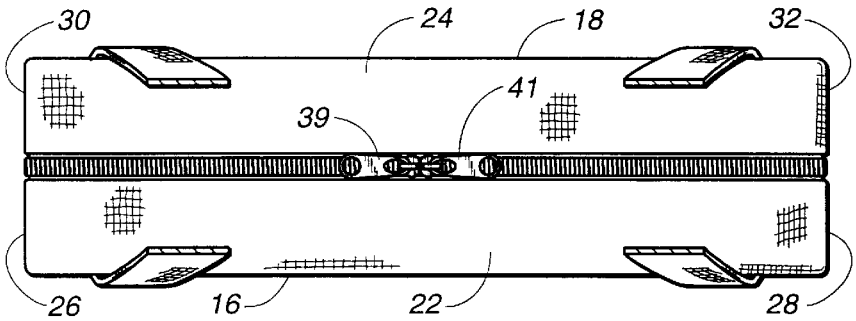
FIG. 8 is a top view of FIG. 6.
Figure 9:
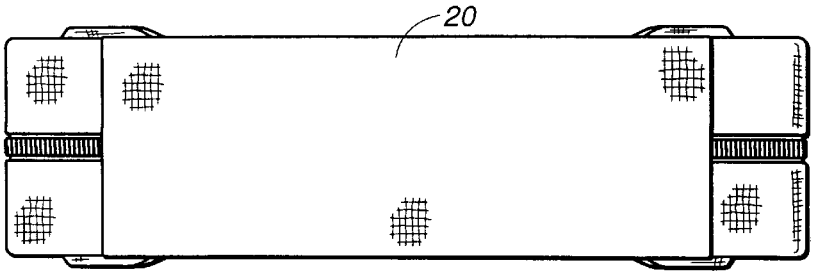
FIG. 9 is a bottom view of FIG. 6.
Figure 10:
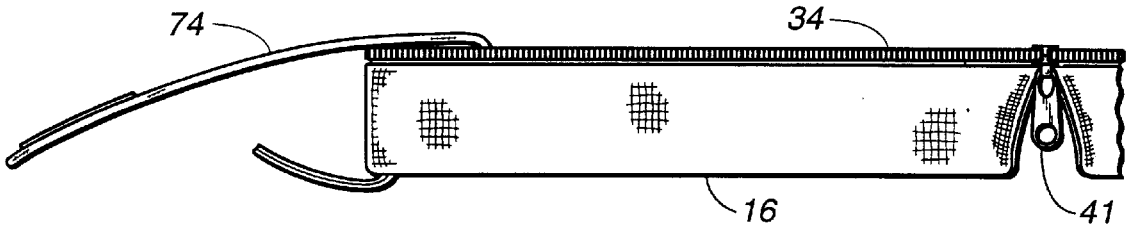
FIG. 10 is a partial side view of FIG. 5 taken at 10—10 showing one of the internal flaps folded open, with part of the lower handle shown cut away.

Referring to FIGS. 6–9, the case is shown to have a generally rectangular box-like configuration with a relatively flat bottom so that it can stand as shown in FIG. 7. The zipper divides the case in half and is arranged to enable the sliders to come together at the top as shown. The zipper also extends into the bottom as shown in FIG. 9 to enable the half shells to fully open as shown in FIG. 10.

Figure 12:
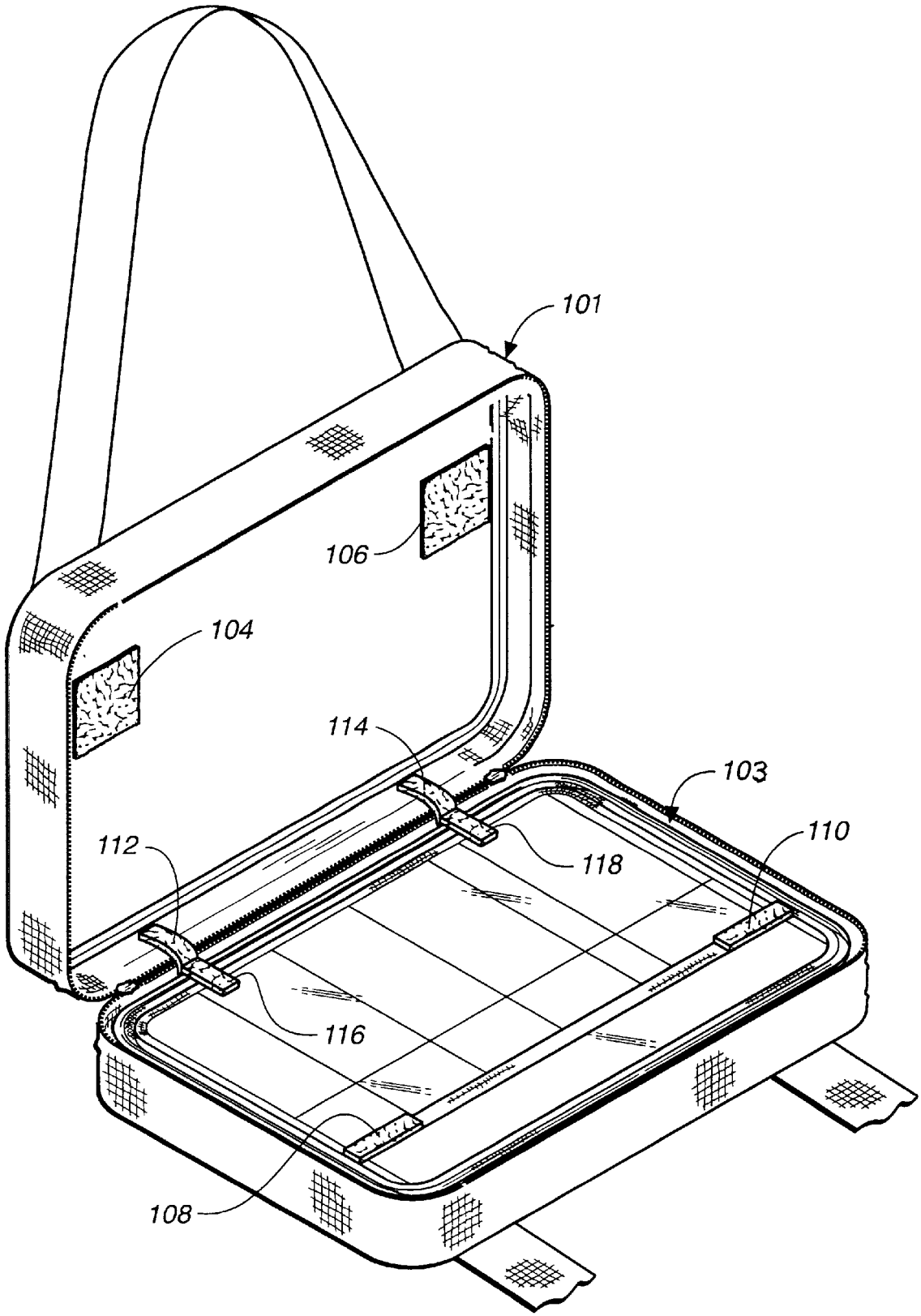
FIG. 12 is a perspective view of an alternate embodiment with the case open to show the removable pocket assembly arrangement.
Figure 13:
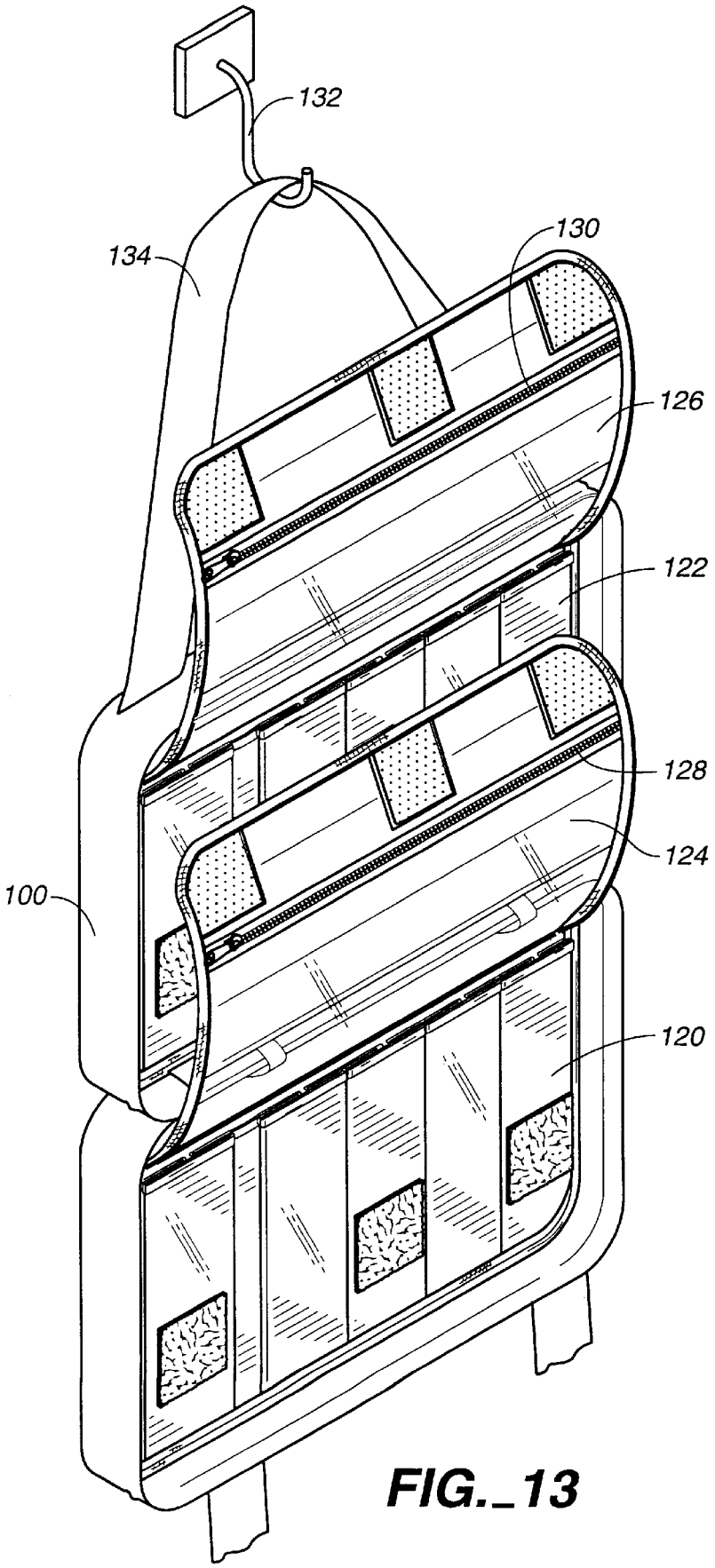
FIG.13 is a perspective view of the embodiment of FIG. 12 with the case hanging up and open to show the removable pocket assembly arrangement.
Figure 14:
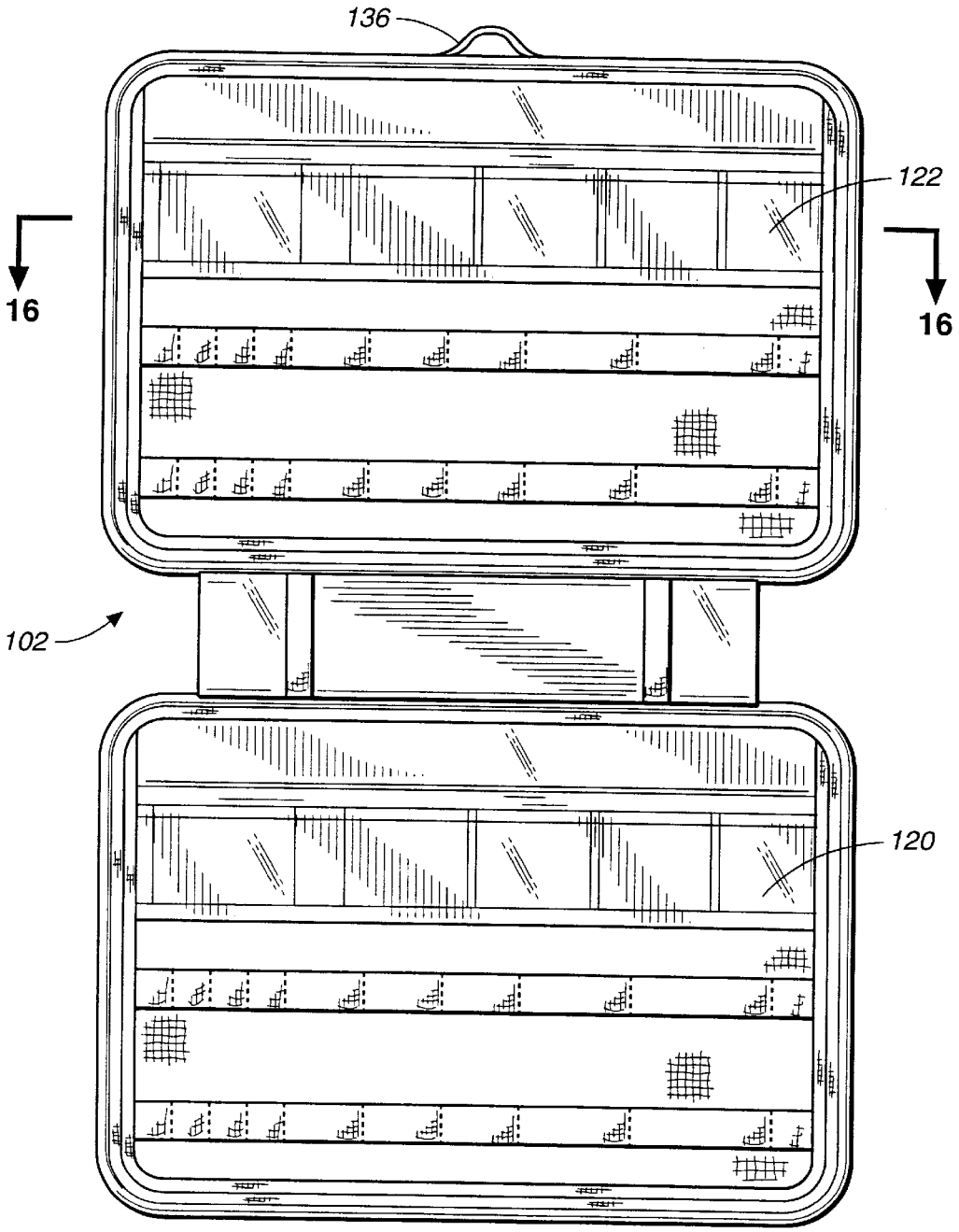
FIG.14 is a front elevational view of the removable pocket assembly of FIG. 12 shown hanging up and closed to show the removable pocket assembly arrangement.

Referring to FIGS. 12–14, a further modification of the case and pocket assembly includes forming the pocket assemblies as a separate integral structure for detachable mounting in the case or shell. The case 101 as illustrated in FIG. 12 is identical to that of the prior embodiment except that the pocket assembly designated generally by the numeral 103 is detachably mounted therein. The upper portion of the pocket assembly is shown detached from the upper half-shell and folded down to show the detachable hook and loop fastening members. Each half-shell has hook and loop fastening pads (upper shown) 104 and 106 on the inside of the back panel for engagement with corresponding pads 108 and 110 on the back of the pocket assembly 103. Additional hook and loop fastening pads or strips 112 and 114 are provided at the juncture of the two half shells with corresponding strips 116 and 118 on the pocket assembly. This provides for complete and secure detachable mounting of the pocket assembly inside the receptacle formed by the shell.

Referring to FIG. 13, the pocket assembly is shown with both pocket units or sections 120 and 122 opening upwardly with closure panels 124 and 126 attached and pivoting above the pocket openings. Each closure panel 124 and 126 forms a pocket with zipper closures 128 and 130. The entire case can be hung on a hook 132 by means of carrying strap 134.

Referring to FIG. 14, the pocket assembly is provided with a hanging loop 136 so that it can be removed from the case and separately hung from a hanger or suitable hook (not shown).

Figure 15:
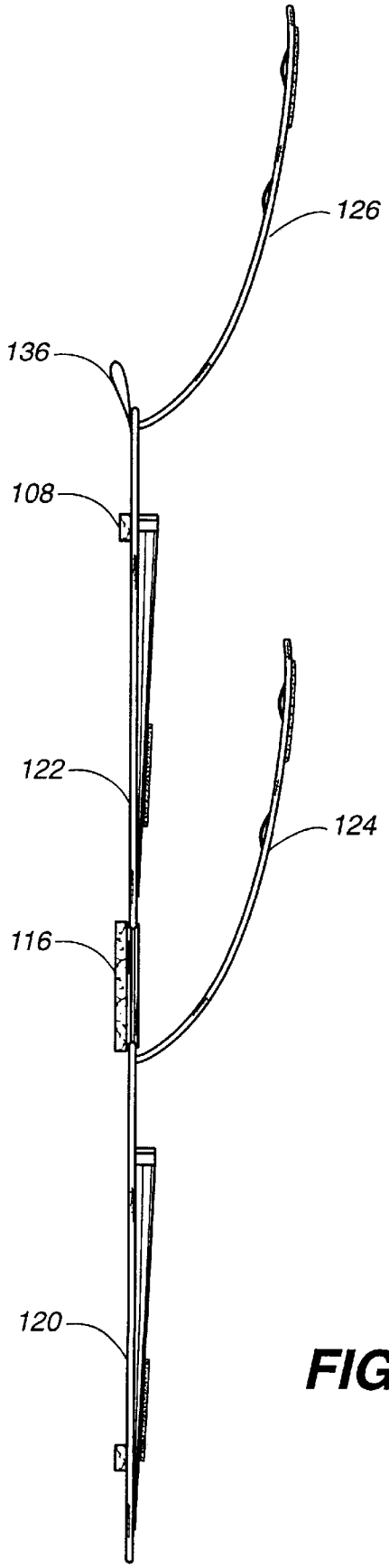
FIG. 15 is a side elevational view of the removable pocket assembly of FIG. 12 with the pockets open to reveal additional details.

Referring to FIG. 15, a side view of the pocket assembly is illustrated showing the two pocket units 120 and 122 on a common backing panel and with the cover panels 124 and 126 in the open position. A loop 136 or other suitable means for hanging the pocket assembly is provided at the top of the assembly.

Figure 16:
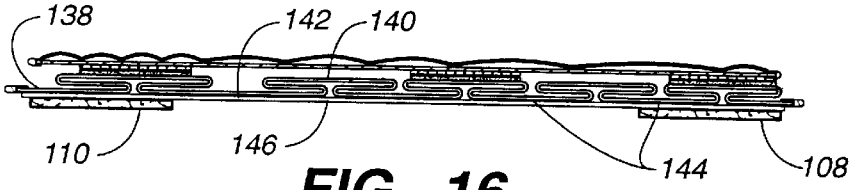
FIG. 16 is a sectional view of the removable pocket assembly taken on line 16—16 of FIG. 14 to reveal additional details.

Referring to FIG. 16, a sectional view of the assembly is illustrated showing details of the pocket construction. As shown, the primary pockets are formed by a pocket panel 138 folded in overlapped accordion fashion with fore panel sections 140 and aft panel sections 142 with folded side sections. The aft panel sections 142 are secured by suitable bonding or sewing along lines 144 to a common back panel 146.

With such an arrangement, a user may use two or more pocket assemblies for interchangeable use with a given case. One pocket assembly, for example, may be filled with personal items for personal traveling, whereas a second pocket assembly may be filled with sales items for a sales trip or business items for other types of business travel. Similarly, a person may have two or more cases of special designs for special occasions and may interchange one or more of the pocket assemblies. The pocket assembly is preferably provided with means such as a loop 136 as described above at a top edge to provide for hanging the assembly on a hanger or the like.

Figure 17:
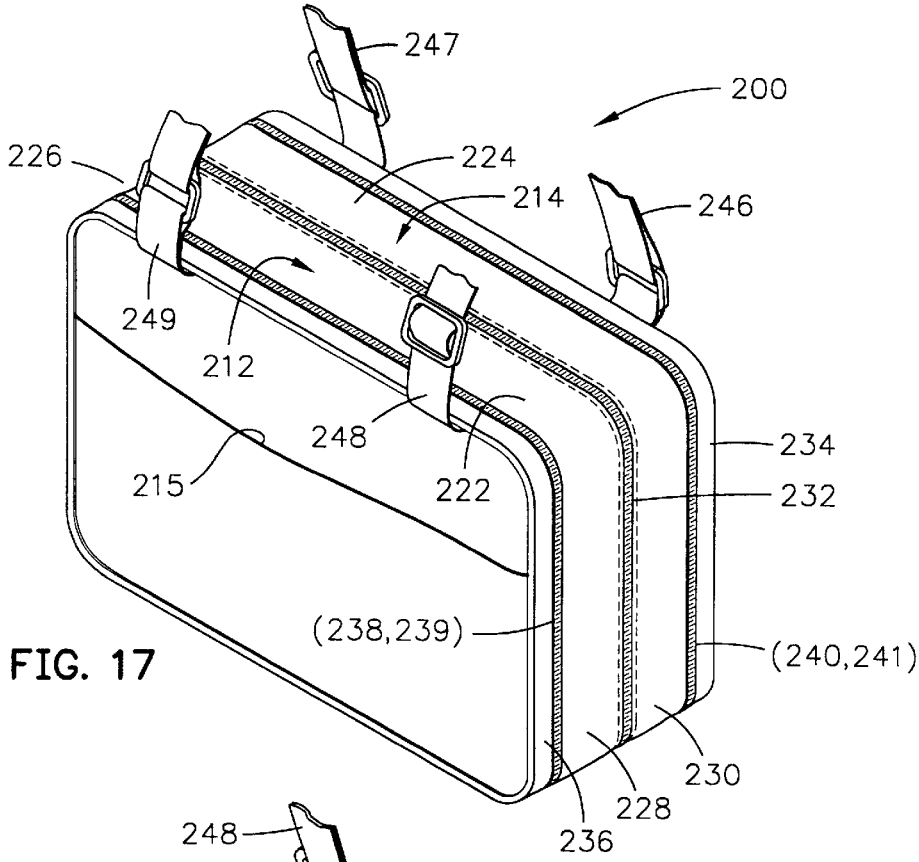
FIG. 17 is a perspective view of an exemplary alternative preferred embodiment of an expandable carrying case for carrying assorted personal clothing in addition to aspects provided in the parent application embodiments.

Expandable Carrying Case: Referring to FIG. 17, another embodiment of a carrying case in expandable form is shown in accordance with the invention and designated generally by the numeral 200. The case is preferably constructed of a pliable material, such as leather, vinyl, or any of the suitable woven materials, now widely used for handbags, purses, suit cases and the like. This embodiment also can include a stiffener such as a cardboard or the like sandwiched between opposing faces within a back panel to provide enclosure stiffening. The case comprises a primary shell formed of a pair of substantially identical half shells 212 and 214, hinged together along a common side and forming a primary receptacle. Each half shell is formed of a generally rectangular panel, with a bottom panel which is preferably common to both primary half shells with a continuous strip forming top panels 222 and 224, end panels 226, 228, and 230, respectively, for forming each of the half shells into the primary receptacle. The half shells are secured together along edges of the side and top panels by zipper elements 232 with sliders (not shown) at each side or end of the zipper elements that surrounds the case perimeter, or alternatively, a hook and loop structure. The bottom panel flexes to serve as a hinge for the two primary half shells.

Figure 18:
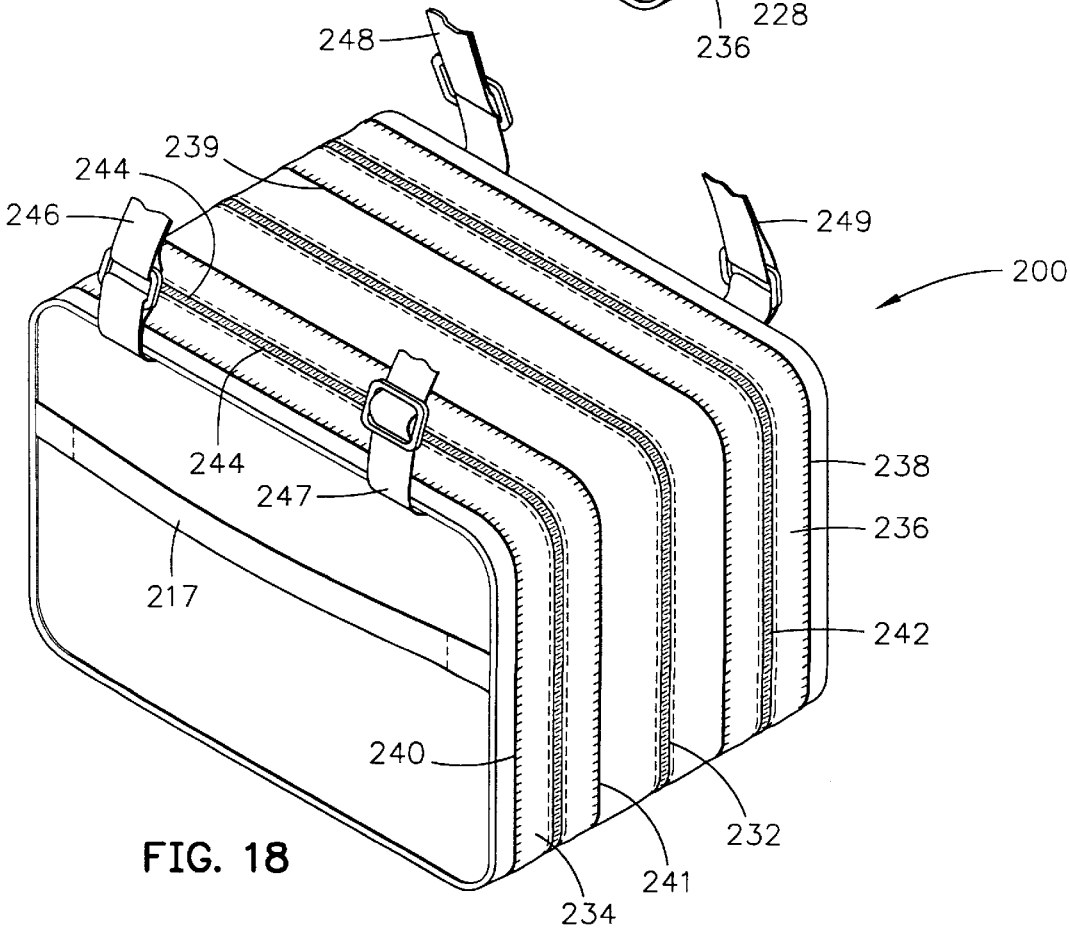
FIG. 18 is a perspective view of the embodiment shown in FIG. 17 when the case is expanded and shows an obverse side of the expandable case.

The expandable carrying case 200 in exemplary form additionally has two auxiliary expandable half shell sections 234 and 236. The external rectangular panels of the half shell sections can have a side storage pocket 215 for holding loose items such as magazines or maps as shown in FIG. 17 or an auxiliary retaining strap 217 attached at a mid-section of the panel for use with a roll-around bag with a collapsible handle (not shown) wherein the collapsible handle can be inserted through the auxiliary retaining strap 217, thus providing a way of securing the expandable case with a roll-around bag for ease of transport as shown in FIG. 18 (an obverse side of the case). These two auxiliary expandable half shell sections are secured together along edges of the side and top panels by zipper elements 238, 239, 240 and 241 with sliders (not shown) at each side or end of the zipper elements which allows for compact carriage of personal items as shown in FIG. 17 or an expanded bag when used as a portable suit case as shown in FIG. 18. Within each expandable auxiliary half shell sections 234 and 236 are two additional zipper elements 242 and 244 with sliders (not shown) which allows for storage of additional items. Thus, the expandable bag can have at least six half shell compartment sides for carriage of assorted items as shown in this exemplary form of the invention. Moreover, this expandable case concept is not limited to only two auxiliary half shell compartments and can include additional auxiliary half shell compartments depending upon design requirements of the case.

Each external auxiliary half shell is provided with a pair of elongated carrying straps 246, 247, 248, and 249, respectively, which detachably secure together at a mid point and are preferably adjustable in length to serve as either a handle or a shoulder strap. The straps, for example, are preferably secured at one end directly to the side of the shell and at the other end through a slip loop and to the shell with the opposite end adjustably secured by a buckle (not shown) underneath a hand grip (not shown). The hand grip is of conventional construction and preferably forms a slip sleeve over the buckle of one of the straps and opening sleeve secured together in a closed position around the other buckle by suitable means, such as a VELCRO (a trademark) hook and loop fastener. This allows adjustment to the straps so that they function as a hand carrying strap or shoulder strap, depending on personal preference.

As seen in FIG. 18, the expandable carrying case 200 is shown in expanded form when the auxiliary half shells 234 and 236 are distended with the zipper elements 238, 239, 240 and 241 parted, thus exposing the zipper elements 242 and 244, which in turn can be unzipped to allow access to a receptacle formed by the auxiliary half shells. Various forms of storage devices, as discussed below and shown in FIGS. 19–26, can be placed within these receptacles formed by the primary and auxiliary half shells; and are designed to configurably attach or be loosely placed within the expandable case 200. These storage devices include, but are not limited to, a multipocket assembly in various forms, a portable carrying case with adjustable partitioning sections within the portable case, and a multipocket assembly in garment bag form. For attaching and securing these various devices in the expandable case, each half-shell can include mutually cooperating hook and loop fastening pads on the inside of the back panel for engaging corresponding pads on the back of one of the accessory storage devices (for example, a pocket assembly device 250 shown in FIG. 20 below). With such an arrangement, a user may use two or more types of pocket assemblies or portable accessory storage devices as described below and shown in FIGS. 19–26 for interchangeable use with the expandable case. One pocket assembly, for example, may be filled with personal care items for traveling, whereas a second pocket assembly may be filled with sales items for a sales trip or business items for other types of business travel. Similarly, a person may have two or more cases of special designs for special occasions and may interchange one or more of the pocket assemblies or portable storage case devices as desired.

Figure 20:
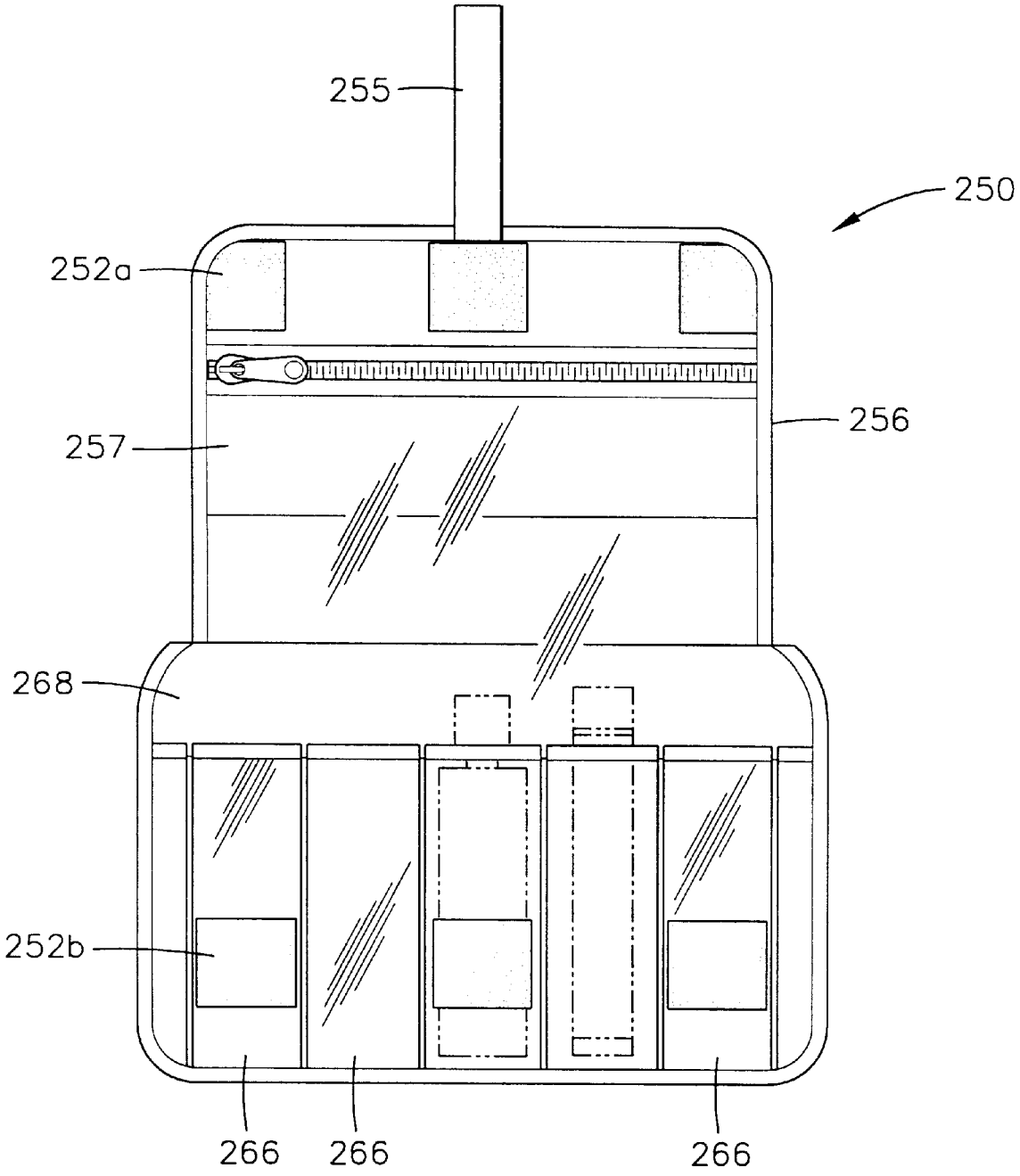
FIG. 20 is a perspective elevational view of the removable pocket assembly shown in FIG. 19 with the assembly open to reveal details.
Figure 19:
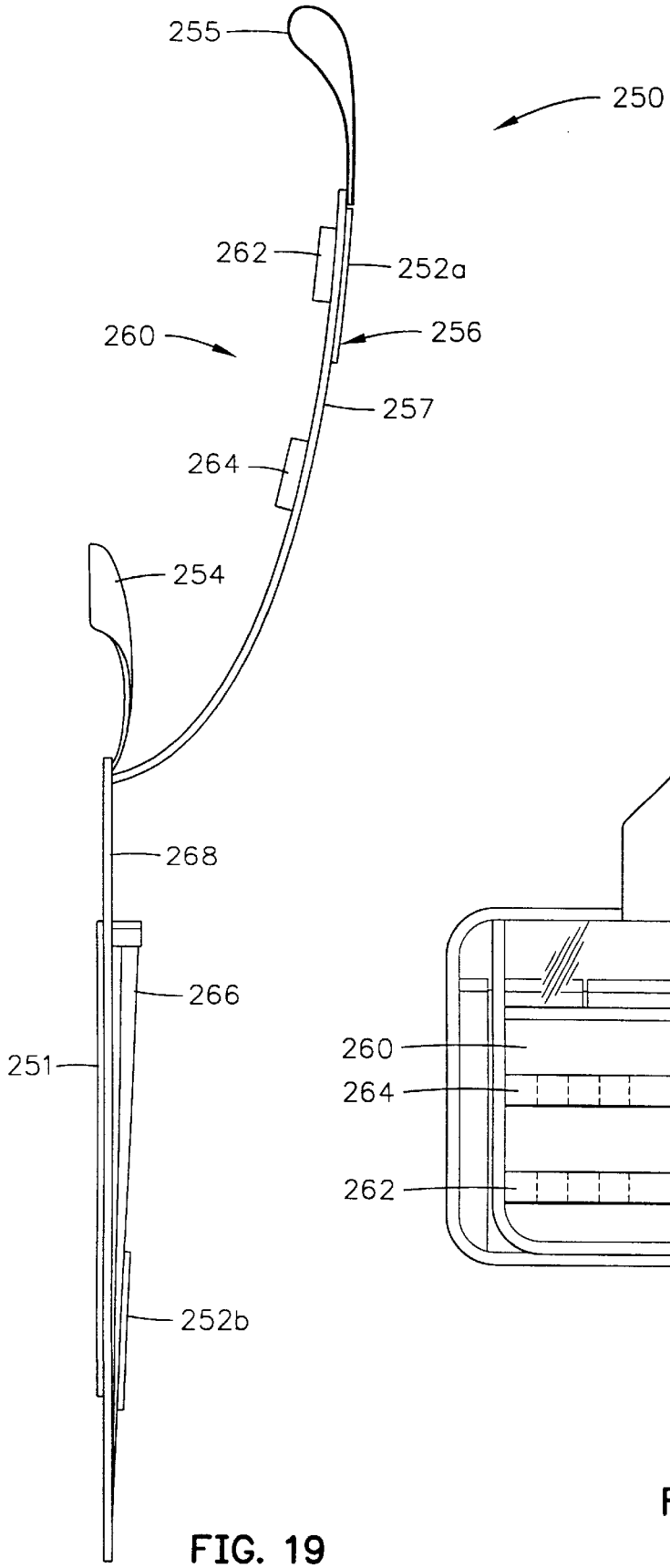
FIG. 19 is a side elevational view of the removable pocket assembly configured for storage in one of the receptacles formed by a half shell shown in FIG. 17.
Figure 21:
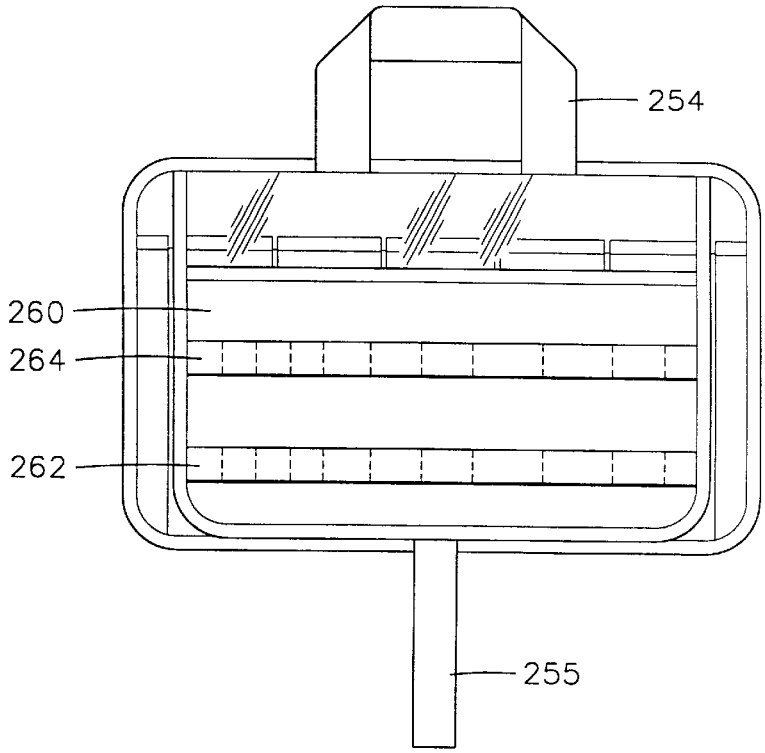
FIG. 21 is a perspective elevational view of the removable pocket assembly shown in FIG. 20 when the assembly is closed to reveal further details.

Referring to FIGS. 19–21, a side and frontal elevational views when open and closed of a removable pocket assembly 250 is shown that is configured for storage within one of the receptacles formed by one of the half shells with a pocket closure cover 256 open with internal securable storage pocket 257 and has a loop 255 for hanging on a hook (not shown). The pocket assembly can have one or more hook and loop fastener means 251 attached to back side of the lower back panel 268 so that it can be secured to one of the back panels of either the primary or auxiliary half shell sections. The folding cover pocket panel 256 has at least one hook and loop fastener 252*a* and 252*b* that secures the pocket assembly in a closed position that also maintains stable placement of articles in the lower panel section with pockets 266 as discussed below. The pocket assembly 250 can be provided with another hanging loop 254 so that it can be removed from the case with ease and can be another way for hanging from a hanger or suitable hook (not shown). The internal zipper fastened internal pocket 257 (FIG. 20) has a common back panel with a cover panel 256 in an open position. On the back side 260 of the foldable cover pocket panel 256 are a pair of elongated elastic straps 262 and 264 secured such as by stitching at multiple points along the face of the panel to form a plurality of loops for holding additional small articles such manicuring implements that can include tweezers, nail files, toe clips, nail clips and the like. These multiple loops have limited elasticity to allow ease of securing to or obtaining from the case any of these small articles. These multiple loops are selectively secured at locations so as to form fit a particular small article.

The bottom sectional portion of the multiple pocket assembly 250 has multiple pockets 266 as similarly shown in FIGS. 14–16. These multiple pockets 266 are formed by a pocket back panel 268 with a folded overlapping accordion-like pockets attached as a fore panel. The fore panel is secured by suitable bonding or sewing along partitioning lines to a common panel 268. This form of the multiple pocket assembly is suitable for use as a personal care organizer for storage of nail care implements, shampoo & hair conditioner, tooth paste, tooth brush holder and the like.

Figure 22:
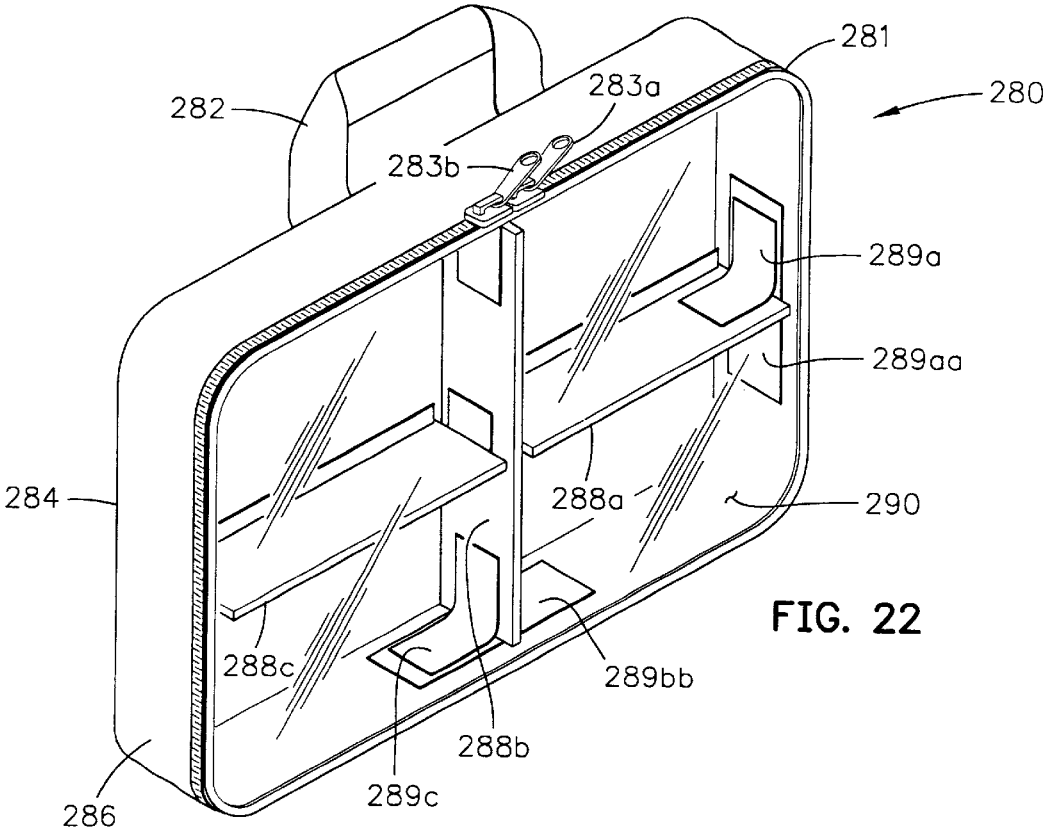
FIG. 22 is a perspective view showing a portable case with adjustable partitionable members that can stored in one of the receptacles formed by one of the half shell shown in FIG. 17 or be used as a stand alone case.

Referring to FIG. 22, a perspective view of another storage device is shown configured for storage in one of the receptacles formed by one of the half shells of the expandable case shown in FIG. 17. This storage device is a portable case 280 that includes adjustable internal partitioning members. Alternatively, this case could be used as a stand alone case that provides adjustable configuring of partitions within the case. The case has a handle 282 for removal from a larger bag and for carrying the case. The case 280 is preferably constructed of a pliable material, such as leather, vinyl, or any of the suitable woven materials, as similarly used in the embodiments discussed above. The case comprises a shell formed of a hinged clear rectangular face cover 290 attached at a lower edge of the case and preferably has a zipper-type fastener 281 that can use two slider 283*a* and 283*b* that come together when closing the case. A back panel 284 attaches to a peripheral panel 286 forming the back and upward sides of the case 280.

Figure 23:
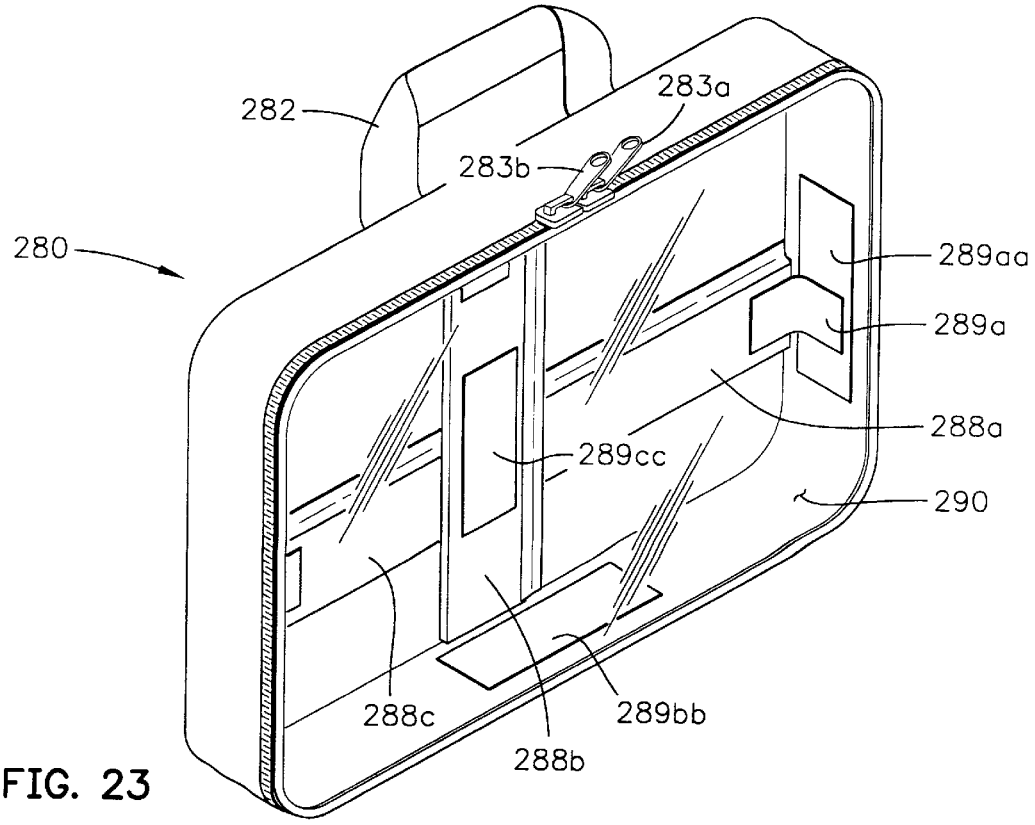
FIG. 23 is another perspective view of FIG. 22 when the adjustable partitioning members in the adjustable partitioned storage case are folded down.

Within the case 280 are foldable partitioning members 288*a*, 288*b*, and 288*c*. The middle partitioning member 288*b* is one piece as shown that bisects the case. The two adjoining members 288*a* and 288*c* are compliant with the middle member 288*b* such that they either one or both fold down flat and rest against the back panel 284 such that either three sectors or an entire interior of the case can be used. The partitioning members are secured in place preferably using mutually fastening hook and loop fasteners 289*a*, 289*b*, 289*c* that each mutually cooperates with their counterparts 289*aa*, 289*bb* and 289*cc*. These fasteners maintain stable partitioning and positioning of the members 288*a*, 288*b*, and 288*c* to be either in a flat state thereby allowing entire use of the case as shown in FIG. 23 where the partitioning members 288*a*, 288*b*, and 288*c* are folded down and secured in place to the back panel 284; or be in an upright position to maintain segregated sections in the case as shown in FIG.

22. Variations of the design as shown in FIGS. 22 and 23 can include more or less partition members depending upon desired case design requirements.

Figure 24:
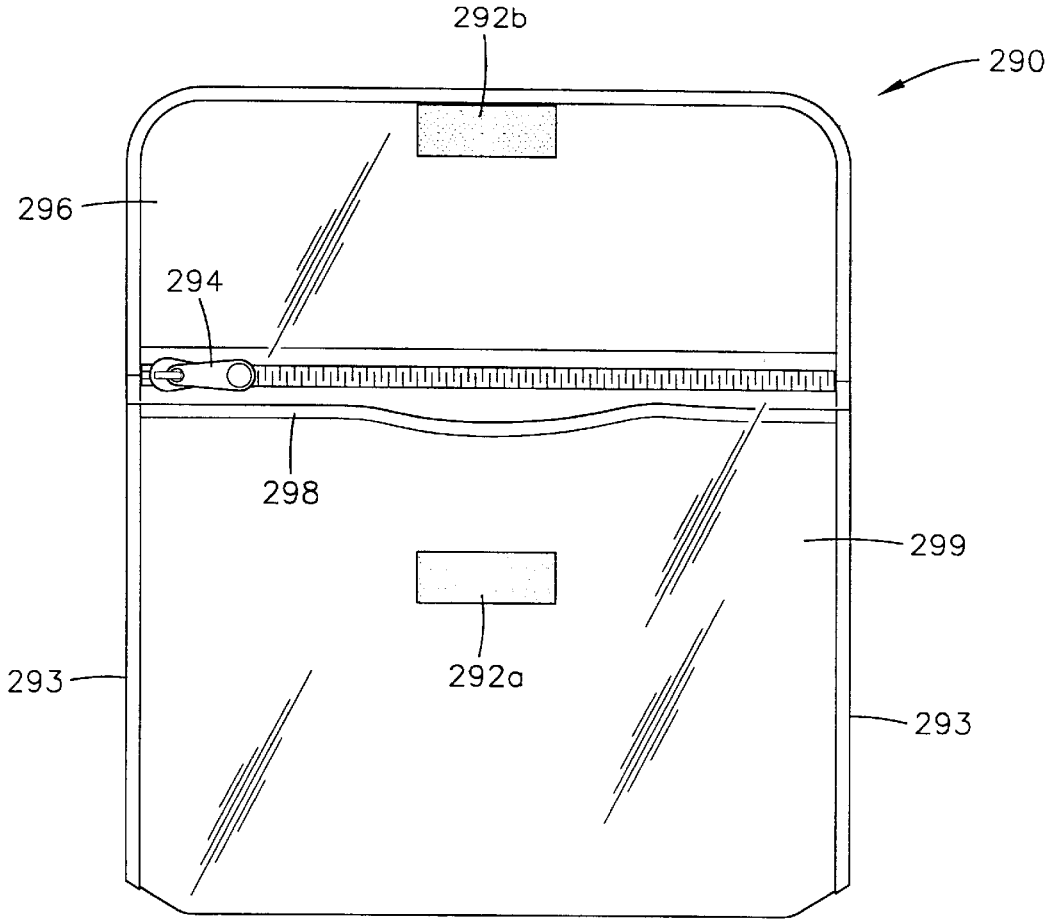
FIG. 24 is a frontal view of another storage device showing an unfolded multiple pocket assembly pouch configured for storing in one of the receptacles formed by one of the half shell shown in FIG. 17.

Referring to FIG. 24, a frontal view of another accessory storage device in an unfolded multiple-pocket assembly 290 is shown configured for placement in one of the receptacles formed by one of the half shells shown in FIG. 17. This case is preferably made of a clear vinyl plastic and has two storage sections and is foldable between the upper and lower storage pockets 296 and 299 respectively. The hook and loop fastener 292*a* and 292*b* can be used to securely retain the pouch in a folded state for placement in the case 200 shown in FIG. 17. In particular, this design as shown has a separate storage pocket 296 with a zipper fastener 294. The lower storage pocket 299 is an expandable pocket with an upper edge 298. This multiple pocket assembly 290, which in a preferred construction, has a common back panel 293 may preferably be a transparent material, such as vinyl or the like. An example of using this storage device includes use as a garment pouch for storage of clothing such as ties in one pocket and shirts in the other.

Figure 26:
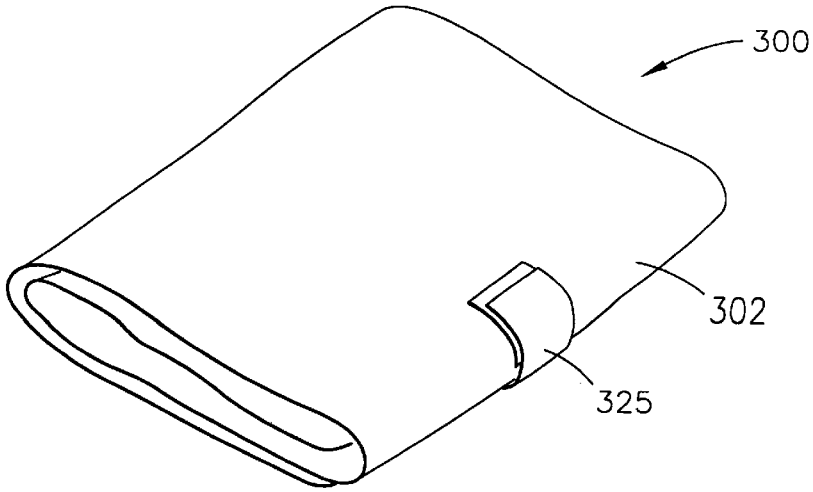
FIG. 26 is another view of FIG. 25 showing the multipocket storage bag assembly folded for storage one of the receptacles formed by one of the half shell shown in FIG. 17.
Figure 25:
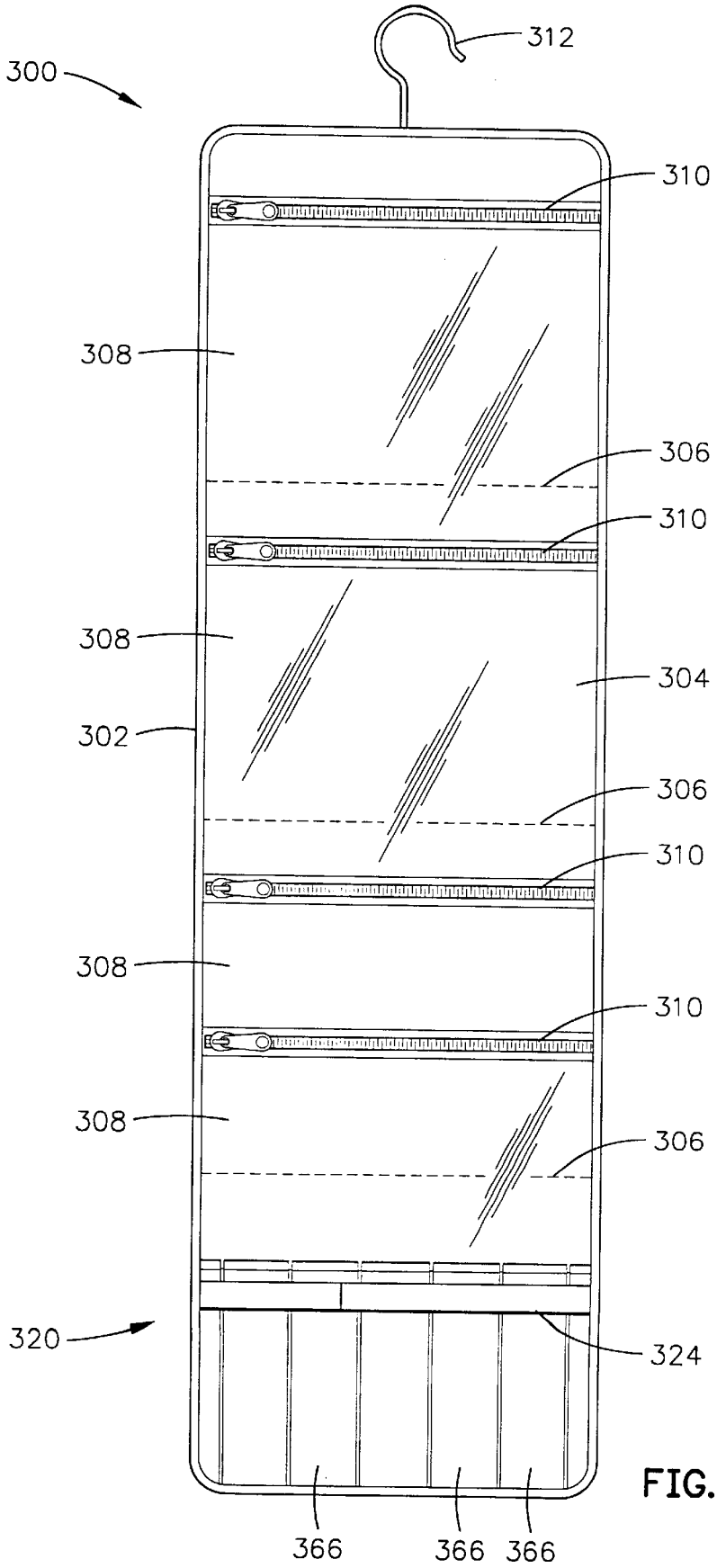
FIG. 25 is a perspective view of another storage device of an unfolded hanging multipocket assembly in bag form.

Referring to FIGS. 25 and 26, a perspective view of an unfolded and folded state of a hanging multipocketed assembly in a storage bag form 300 is shown that can be inserted in one of the half shells of the expandable case 200. This form of the multipocket assembly has multiple storage pockets 308 with closure fasteners 310 that include, but are not limited to, zippers and sliders, hook and loop fasteners and snaps and the like. In a preferred construction, the assembly is formed on a common back panel 302, which may be a transparent or opaque material and is pliable for ease of folding the assembly into a rolled assembly for ease of storing in the case 200. The face side 304 of the bag assembly 300 is preferably a clear vinyl that includes partitioning stitches 306 that segregate individual pockets for efficient construction of the assembly 300. The assembly 300 is preferably provided with hanging members such as a hook 312 at a top edge for hanging the assembly 300 on a hanger or the like. The assembly 300 also includes a lower section 320 with opened top multipocket designated 366 as similarly shown and described in FIGS. 19 and 20 above. An elastic strap 324 is included for securing items within pockets in this lower section of the garment bag assembly 300. This lower pocket section 320 is preferably used for clothing items such as socks, underwear and the like, but can be used for storing personal care items. FIG. 25 shows the garment bag assembly 300 in folded state where a hook and loop fastener 325 is attached to the back face panel 302 of the assembly for securing in a folded state for storage in one of the receptacles formed by one of the half shells shown in FIG. 17.

While I have illustrated and described my invention by means of specific embodiments, it is to be understood that numerous changes and modifications may be made therein without departing from the spirit and the scope of the invention as shown in the appended claims.

I claim:

1. An expandable carrying case comprising:

a primary shell of pliable material, the primary shell formed of a pair of substantially identical primary half shells connected together for hinging along a common side and forming a primary receptacle, each the primary half shell formed of a rectangular back panel with a bottom panel, a top panel and two end panels secured along the periphery of the back panel forming the primary receptacle; and a first and a second auxiliary shell of pliable material, wherein each said auxiliary shell being connected and hinged along the common side and forming an auxiliary receptacle on each side of said primary receptacle, each said auxiliary shell having a rectangular auxiliary back panel with a bottom panel, a top panel and two end panels secured along the periphery of the auxiliary back panel thereby forming each auxiliary receptacle, and each said auxiliary shell having an inner fastener and an outer fastener, the outer fastener releasably secures laterally spaced portions of the bottom, top and two end panels together so that the outer fastener adjusts size of the carrying case and the inner fastener releasably secures separable portions of the top and two end panels together and provides a means for opening and securing each auxiliary receptacle; and a multipocket assembly device that configurably stores within the carrying case, the pocket assembly comprising a foldable closure pocket panel and a front pocket panel, the front pocket including a pleated pocket panel section that forms a plurality pockets having an open top being generally the same length and shaped and configured to receive articles, and the foldable closure pocket panel configured to simultaneously overlap and close the open top of the plurality of pockets to secure the articles therewithin.

2. The carrying case of claim 1 wherein the multipocket assembly device includes means for attaching to a back panel within the carrying case.

3. The carrying case of claim 1 wherein the foldable pocket panel is transparent and has means for hanging the foldable pocket panel from a hook.

4. The carrying case of claim 1 wherein the foldable pocket panel is detachably secured over the front pocket panel by a hook and loop fastener.

5. The carrying case of claim 1 wherein the pockets on the multipocket assembly are formed so that when the first pockets are partially filled, space is available between the adjacent pockets for an article.

6. The carrying case of claim 1 wherein the multipocket assembly has a pair of elongated elastic straps secured at multiple points along back side of the foldable closure pocket panel so as to form a plurality of loops for holding articles of specified size.

7. The carrying case of claim 1 wherein the multipocket assembly comprises two identical groupings of pockets on a common pocket back panel, and the pockets on the pocket panel have openings oriented in a common direction.

8. The carrying case of claim 1, wherein the multipocket assembly device comprising:

at least two storage pockets comprising a foldable upper and lower storage pockets, the at least two storage pockets are foldable and have an attached means for securing the assembly device.

9. The carrying case of claim 8 wherein the foldable upper and lower storage pockets is transparent and the multipocket assembly device has means for hanging from a hook.

10. The carrying case of claim 1, wherein the multipocket assembly device comprising:

plurality of storage pockets, each having closure fasteners wherein each storage pocket is formed on a common back panel and made of a material that is pliable so as to allow folding into a rolled form for placement in one of the half shells of the carrying case.

11. The carrying case of claim 10, wherein the multipocket assembly device further comprising an attached bottom portion having a front pocket panel, the front pocket panel including a pleated pocket panel section that forms a plurality of pockets having an open top being generally the same length and shaped and configured to receive articles; and a connectable elastic strap that folds over the upper portion of the pleated pocket section so as to secure articles retained within the plurality of pockets.

12. The carrying case of claim 10 wherein the multisectioned case device further having a means for hanging the case device from a hook.

13. The carrying case of claim 1 further comprising in kit form, a multisectioned case device that configurably inserts within the expandable carrying case, the multisectioned case device comprising:

a shell receptacle having a back panel and a peripheral panel forming the sides of the multisectioned case device;

a hinged rectangular face covering member attached to a side of the multisectioned case device with a fastener for securing the multisectioned case device; and at least one foldable partitioning member attached to the back panel of the multisectioned case device that can form a closed sub-region withing the case device, each partitioning member has at least one partition fastener attached at an end portion of that partitioning member, the at least one partition fastener cooperatively and selectively connects to an inner surface of the multisectioned case device and other partitioning members if there are a plurality of partitioning members, so as to allow selective and stable positioning of the at least one partitioning member for preferred organization of articles placed within the case device.

14. The carrying case of claim 1 wherein one of said first and second auxiliary shell has a pocket formed on an outer shell for storage of loose items that are readily accessible to a user.

15. The carrying case of claim 1 wherein one of said first and second auxiliary shell has an insertable retention strap attached to edges of an external surface of the at least one auxiliary shell so as to retain the expandable carrying case by an extendable handle forming part of another roll-around carrying bag.

* * * * *

UNITED STATES PATENT AND TRADEMARK OFFICE

CERTIFICATE OF CORRECTION

PATENT NO. : 6,183,133 B1
DATED : February 6, 2001
INVENTOR(S) : DeAnna Roegner

It is certified that error appears in the above-identified patent and that said Letters Patent is hereby corrected as shown below:

Title page,
Item [54], column 1,
Title should read "EXPANDABLE MULTIPOCKET CARRYING CASE"

Signed and Sealed this

Second Day of October, 2001

*Attest:*

Nicholas P. Godici

*Attesting Officer*

NICHOLAS P. GODICI
*Acting Director of the United States Patent and Trademark Office*